United States Patent [19]

Rohs

[11] Patent Number: 5,050,799

[45] Date of Patent: Sep. 24, 1991

[54] INJECTION NOZZLE FOR LIQUID MEDIA

[76] Inventor: Ulrich Rohs, Roonstrasse 11, D-5160 Düren, Fed. Rep. of Germany

[21] Appl. No.: 524,704

[22] Filed: May 15, 1990

Related U.S. Application Data

[63] Continuation of Ser. No. 787,919, Oct. 16, 1985, abandoned.

[51] Int. Cl.[5] ..... B05B 1/34; F02M 61/00

[52] U.S. Cl. ..... 239/124; 239/463

[58] Field of Search ..... 239/124, 125, 461, 463

[56] References Cited

U.S. PATENT DOCUMENTS

| | | | |
|---|---|---|---|
| 2,308,909 | 1/1943 | Blanchard | 239/125 |
| 2,313,298 | 3/1943 | Martin et al. | 239/124 X |
| 2,345,402 | 3/1944 | Lubbock et al. | 239/126 X |
| 2,374,041 | 4/1945 | Saha | 239/124 X |
| 2,783,087 | 2/1957 | Rainson et al. | 239/126 X |
| 3,587,977 | 6/1971 | Fussner et al. | 239/124 X |

FOREIGN PATENT DOCUMENTS

| | | | |
|---|---|---|---|
| 2407856 | 8/1975 | Fed. Rep. of Germany . | |
| 3417657 | 11/1985 | Fed. Rep. of Germany . | |
| 1016451 | 11/1952 | France | 239/125 |

*Primary Examiner*—Andres Kashnikow
*Assistant Examiner*—Lesley D. Morris
*Attorney, Agent, or Firm*—Collard, Roe & Galgano

[57] ABSTRACT

An injection nozzle for injecting extremely small quantities of a liquid medium, e.g., fuel, includes a nozzle body having a swirl space, a cover plate with an outlet opening, and a return duct arranged to the rear of the outlet opening. Injector bores connect the return duct directly to the swirl space and/or with a receiving chamber surrounding the swirl space.

3 Claims, 3 Drawing Sheets

INJECTION NOZZLE FOR LIQUID MEDIA

This is a continuation of copending application Ser. No. 06/787,919, filed on Oct. 16, 1985, now abandoned.

BACKGROUND OF THE INVENTION

This invention relates to an injection nozzle for liquid media. More particularly, it relates to an injection nozzle for injecting extremely small amounts of liquid fuel in combustion systems and engines.

An injector nozzle is known (see DE-PS 24 07 856) which has been found to be well suited for injecting fuel in amounts of from 0.05 to 10 kg/hour. This known nozzle includes a nozzle body having an inlet duct joined to swirl ducts feeding tangentially into a swirl space. In addition, a central return duct is disposed in the core of the body of the nozzle. The swirl space is substantially formed by a ring-shaped recess in the body of the nozzle and a cover plate having a central outlet opening is secured on the body. The cover plate and the frontal surface of the core, is limited or defined by the swirl space, and jointly form a disk-shaped gap. The gap connects the swirl space with the outlet opening of the cover plate on one side and with the return duct on the other side. The cross section of the outlet opening is several times the size of the superficies or outside facing surfaces of the disk-shaped gap.

However, the increasingly exacting requirements with respect to environmental protection and the fuel economy of combustion systems and engines requires a further reduction of the amounts of fuel injected. Still, the further refinement of injector nozzles has limitations. For example, any further reduction of the cross section of the bore would readily lead to clogging by impurities or contaminants or to occlusion caused by combustion. Attempts have been made to manufacture the body of the nozzle from gem or glass or the like, in order to minimize the boundary layer by using smooth surfaces, as the formation of a boundary layer presents another obstacle. Similarly, suction of the return bore would be unsuitable because this would cause undesirable noise.

Accordingly, it is an object of the invention to provide an improved injection nozzle of the above-specified type that can inject even extremely small amounts of fuel in a reliable manner without an appreciable additional expenditure.

SUMMARY OF THE INVENTION

These and other related objects are readily attained in a nozzle of the type including a nozzle body having a front surface and a central core with a front area, a central return duct disposed in the core, an inlet duct, a swirl space at least partially defined by an annular recess formed in the front surface of the nozzle body and surrounding the core front area, and at least one swirl duct joined to the inlet duct and leading tangentially into the swirl space. A cover plate having a central opening is secured on the nozzle body, with the core front area and the plate defining therebetween a disk-shaped gap connecting the swirl space to the outlet opening on the one side, and to the return duct on the other side. The outlet opening has a cross section area substantially larger than the area of the superficies of the disk-shaped gap. The swirl space and/or a receiving chamber surrounding and connected to the swirl space is directly connected to the return duct by at least one injector bore for injecting extremely small quantities of the liquid medium.

Preferably, the nozzle includes a flow controller arranged in the return duct. Most desirably, the cross section of the injector bores is, at the most, 50% of the cross section of the return duct.

In a preferred embodiment of the invention, a receiving chamber surrounding and connected to the swirl space, connected to the inlet duct and directly connected to the return duct by at least one injector bore, for injecting extremely small quantities of the liquid medium is additionally included.

In the nozzle according to the invention, the amount of fuel or injection medium returned is increased to such an extent that extremely low amounts of medium remain for ejection, in spite of feeding relatively large amounts of medium to the nozzle. For example, if with an injection nozzle of the known design, the total medium feed is reduced by about 50% by way of the return duct, another 40% of the medium feed is withdrawn by the injector ducts in the present invention. This means that about 10% of the total feed remains available for injection in the present invention.

In addition, the invention provides a savings in energy and material use. For example, instead of using a heating oil fuel pump, which until now was operated at about 25 bar, it is now possible to use a pump operating at 15 bar.

Moreover, with the help of the injector bores, an underpressure is produced in the return duct for sucking a sufficient amount of medium from the swirl chamber.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE DRAWINGS

In the drawings, wherein similar characters denote similar elements throughout the several views.

DETAILED DESCRIPTION OF THE PREFERRED EMBODIMENT

Figure 1:
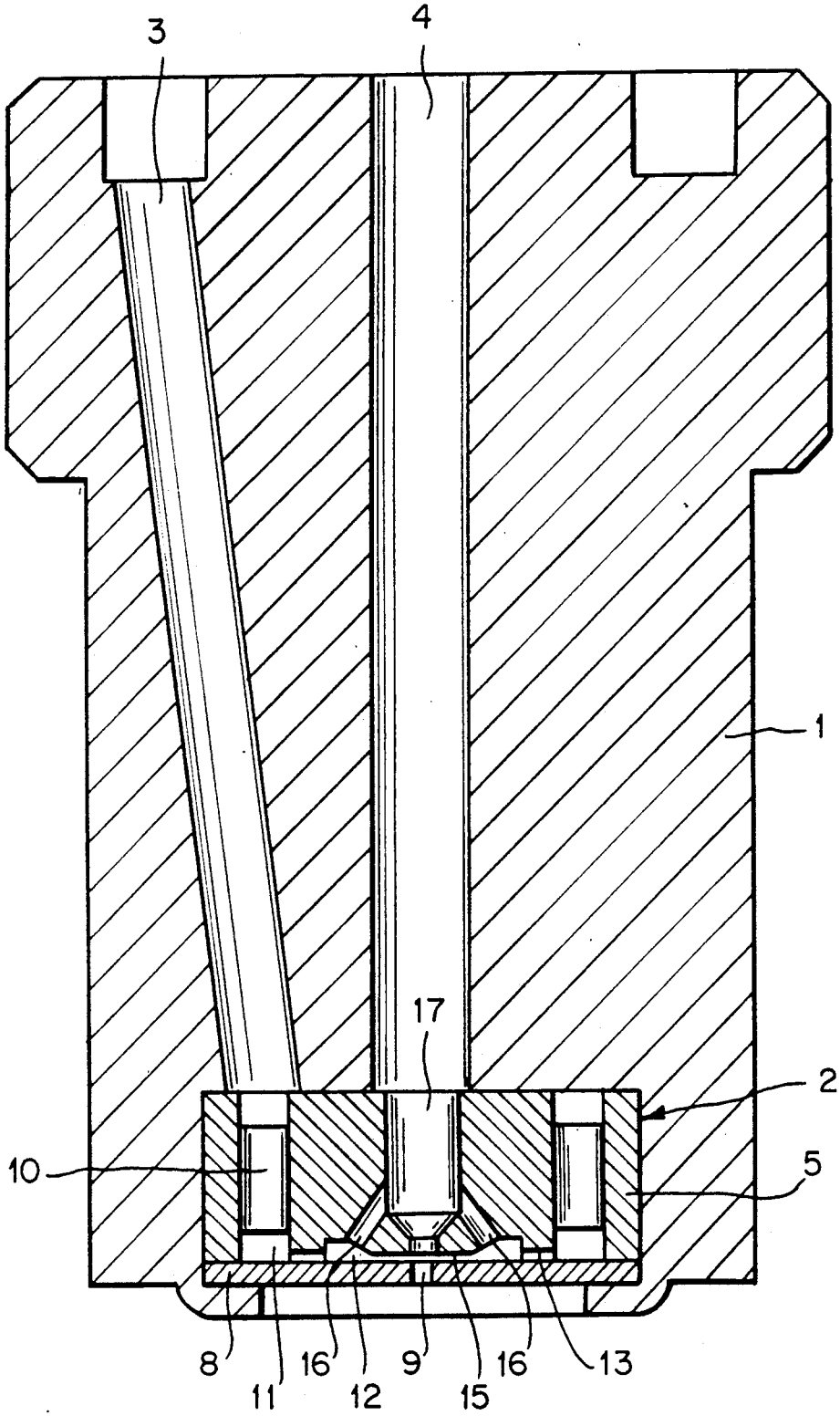
FIG. 1 is a longitudinal sectional view of the injection nozzle according to the invention arranged in a nozzle holder.

Turning now in detail to the appended drawings and, in particular FIG. 1 thereof, therein illustrated is a nozzle holder 1 with an injection nozzle 2 embodying the present invention supported therein and a feed line or duct 3 for the medium to be injected, connected to the nozzle. A central return duct 4 is also connected to and extends from the nozzle.

Figure 3:
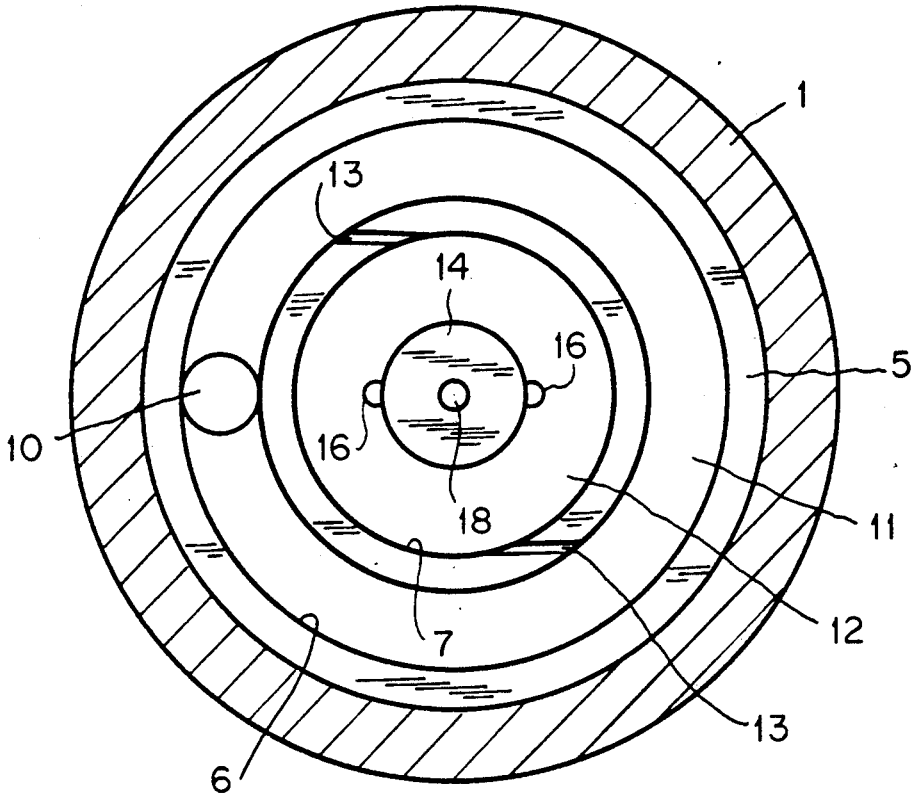
FIG. 3 is a cross-sectional view of the injection nozzle taken along line III—III in FIG. 2.
Figure 2:
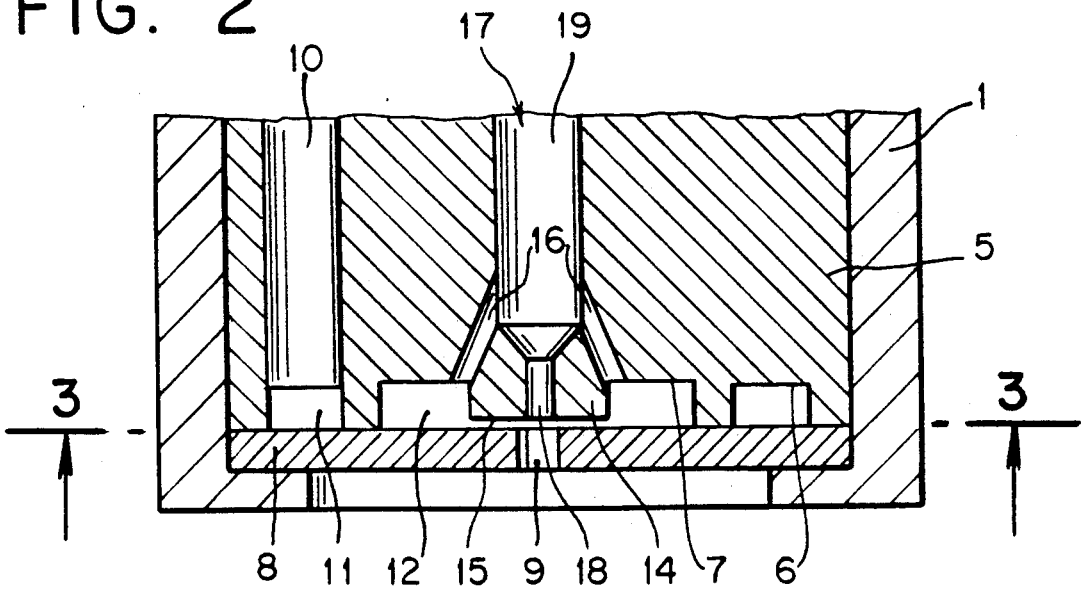
FIG. 2 is an enlarged, fragmentarily-illustrated longitudinal sectional view of a second embodiment of the injection nozzle according to the invention.

As shown best in FIGS. 2 and 3, injection nozzle 2 includes a nozzle body 5 with grooves 6 and 7 provided concentrically in its front face or surface. A cover plate 8 provided with a central outlet opening 9 is mounted on the front surface of nozzle body 5. An annular receiving chamber 11 is formed by groove 6 and cover plate 8 and is connected with feed duct 3 by a bore 10 provided in nozzle body 5 which serves as the inlet duct. As can be seen in FIG. 3, the tangential swirl ducts 13 are provided between receiving chamber 11 and the swirl space 12, the latter being formed by inner annular groove 7 and cover plate 8. Core 14 is surrounded by swirl space 12. The front surface of core 14 of nozzle body 5 and cover plate 8 jointly form a disk-shaped gap 15 whose superficies or outer edge surface is many times smaller than the cross section of the outlet opening 9 in cover plate 8. It is possible even to have cover plate 8 elastically resting on the front surface of core 14, so that disk-like gap 15 is practically non-existent in the resting state, the gap becoming slightly larger only under the injection pressure.

Figure 4:
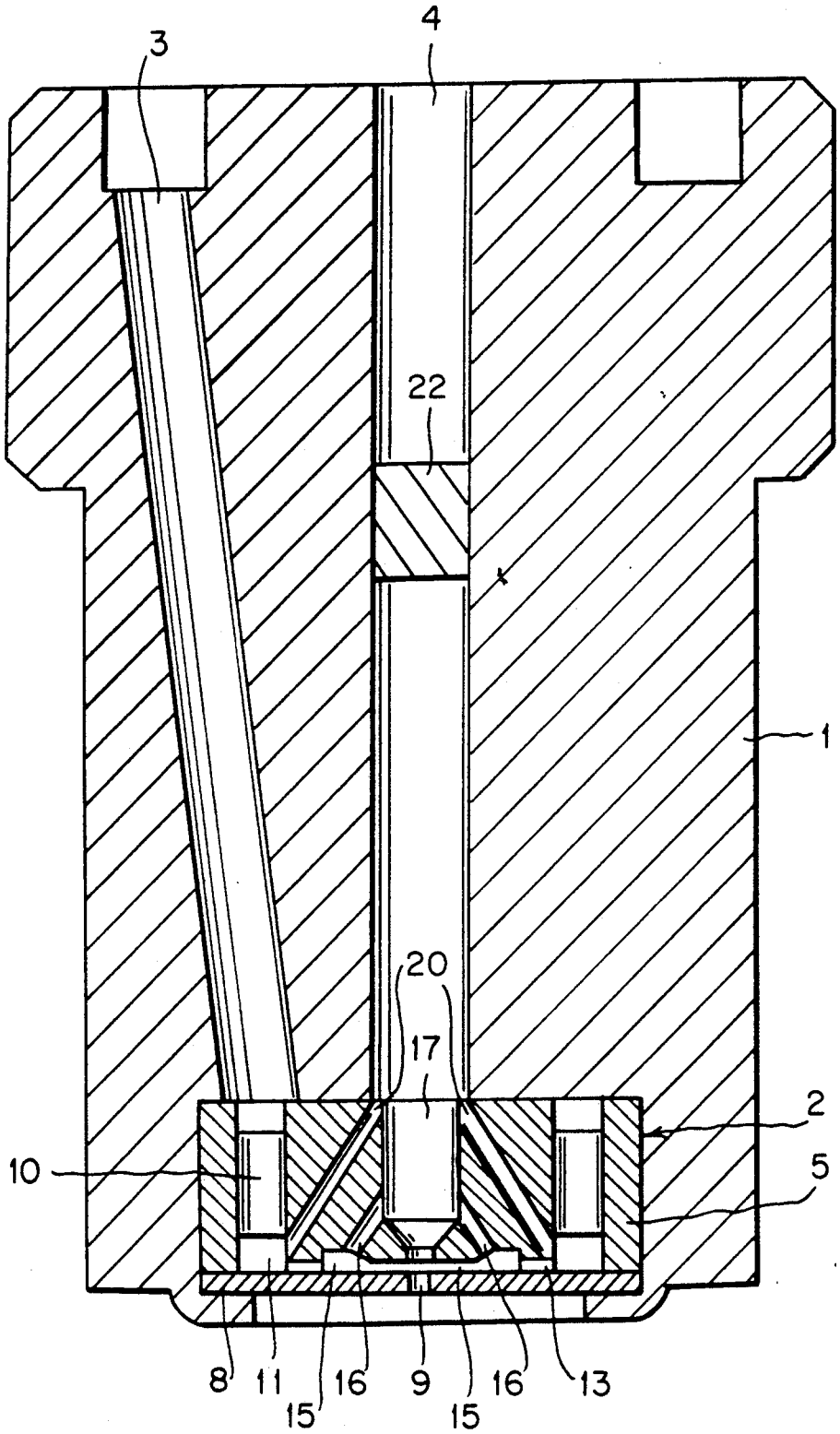
FIG. 4 is a longitudinal sectional view of yet another embodiment of the invention.

As shown in FIG. 1, injection nozzle 2 has a central return duct 17 connected to return duct 4. Duct 17 is designed in the form of a bore extending through body 5 of the nozzle, and aligned with outlet opening 9. As illustrated in FIG. 2, return duct 17 is divided into two sections 18 and 19 having different diameters. Front section 18 which extends from the front surface of core 14 has a cross section approximately conforming to or slightly larger than the cross section of outlet opening 9, whereas rear section 19 has a relatively larger cross section. This configuration permits a particularly advantageous return of the injected medium. Injector bores 16 extend from section 19 of return duct 17 to the inner edge of swirl space 12. In this way, a portion of the injected medium present in swirl space 12 is diverted into return duct 17. In the embodiment shown in FIG. 4, another injector bore 20 may be provided between return duct 17 and receiving chamber 11 in addition to, or instead of, injector bores 16. In this way, the withdrawal of injection medium is increased before the medium reaches the outlet opening 9. To further increase the withdrawal of injection medium yet another injector bore 20' may be provided between return duct 17 and receiving chamber 11. Advantageously, a control element, schematically represented by reference numeral 22 in FIG. 4, for further controlling the amount of medium returned is arranged in the return duct 4 in a conventional manner.

While only several embodiments of the present invention have been shown and described, it is obvious that many changes and modifications may be made thereunto, without departing from the spirit and scope of the invention.

What is claimed is:

1. In an injection nozzle for liquid media, such as fuel and the like, of the type including a nozzle body having a front surface and a central core with a front area, a central return duct disposed in said core, an inlet duct, a swirl space at least partially defined by an annular recess formed in said front surface of said nozzle body and surrounding said core front area, at least one swirl duct joined to said inlet duct and leading tangentially into said swirl space, a cover plate having a central opening, secured on the nozzle body, said core front area and said plate defining therebetween a disk-shaped gap connecting said swirl space to a space between said outlet opening and said return duct and thus causing a pressure drop between said swirl space and said space between said outlet opening and said return duct, said outlet opening having a cross section area substantially larger than the area of the superficies of the disk-shaped gap, the improvement comprising:

said swirl space being directly connected to said return duct by at least one injector bore, a receiving chamber surrounding and connected to said swirl space, said receiving chamber also being connected to the inlet duct and directly connected to the return duct by at least one injector bore.

2. In an injection nozzle for liquid media, such as fuel and the like, of the type including a nozzle body having a front surface and a central core with a front area, a central return duct disposed in said core, an inlet duct, a swirl space at least partially defined by an annular recess formed in said front surface of said nozzle body and surrounding said core front area, at least one swirl duct joined to said inlet duct and leading tangentially into the swirl space, a cover plate having a central outlet opening, secured on the nozzle body, said core front area and said plate defining therebetween a disk-shaped gap connecting said swirl space to a space between said outlet opening and said return duct and thus causing a pressure drop between said swirl space and said space between said outlet opening and said return duct, said outlet opening having a cross section area substantially larger than the area of the superficies of the disk-shaped gap, the improvement comprising:

a receiving chamber surrounding and connected to said swirl space and said inlet duct, and connected directly with said return duct by at least one injector bore.

3. The injection nozzle as defined in claim 2, wherein said receiving chamber surrounding and connected to said swirl space and said inlet duct is connected directly with said return duct by two injector bores.

* * * * *